US005136919A

United States Patent [19]

Wolstein

[11] Patent Number: 5,136,919

[45] Date of Patent: Aug. 11, 1992

[54] GUITAR PICKUP AND SWITCHING APPARATUS

[75] Inventor: Robert J. Wolstein, Ventura, Calif.

[73] Assignee: Gibson Guitar Corp., Nashville, Tenn.

[21] Appl. No.: 467,660

[22] Filed: Jan. 18, 1990

[51] Int. Cl.[5] ..... G10H 3/12; G10H 1/18

[52] U.S. Cl. ..... 84/742; 84/735

[58] Field of Search ..... 84/723, 725–728, 84/730, 731, 734, 735, 737, 742, 743, DIG. 27

[56] References Cited

U.S. PATENT DOCUMENTS

| | | | |
|---|---|---|---|
| 2,784,631 | 3/1957 | Fender | 84/1.15 |
| 3,073,202 | 1/1963 | Evans | 84/1.14 |
| 3,478,158 | 11/1969 | Trainor | 84/1.16 |
| 3,544,696 | 12/1970 | Broussard | 84/1.15 |
| 3,915,048 | 10/1975 | Stich | 84/1.14 |
| 4,010,668 | 3/1977 | Plueddemann | 84/1.16 |
| 4,024,789 | 5/1977 | Humphrey et al. | 84/477 R |
| 4,151,776 | 5/1979 | Stich | 84/1.16 |
| 4,164,163 | 8/1979 | Rhodes | 84/1.15 |
| 4,175,462 | 11/1979 | Simon | 84/1.16 |
| 4,222,301 | 9/1980 | Valdez | 84/1.15 |
| 4,245,540 | 1/1981 | Groupp | 84/1.14 |
| 4,305,320 | 12/1981 | Peavey | 84/1.16 |
| 4,319,510 | 3/1982 | Fender | 84/1.15 |
| 4,331,060 | 5/1982 | Allen | 84/454 |
| 4,379,421 | 4/1983 | Nunan | 84/728 |
| 4,408,513 | 10/1983 | Clevinger | 84/1.15 |
| 4,418,599 | 12/1983 | Raskin | 84/741 X |
| 4,419,916 | 12/1983 | Aoki | 84/1.01 |
| 4,480,520 | 11/1984 | Gold | 84/1.16 |
| 4,481,854 | 11/1984 | Dugas | 84/736 |
| 4,545,278 | 10/1985 | Gagon et al. | 84/1.15 |
| 4,580,480 | 4/1986 | Turner | 84/1.14 |
| 4,581,974 | 4/1986 | Fender | 84/725 |
| 4,581,975 | 4/1986 | Fender | 84/1.15 |
| 4,632,002 | 12/1986 | Clevinger | 84/1.16 |
| 4,711,149 | 12/1987 | Starr | 84/742 |
| 4,817,486 | 4/1989 | Saunders | 84/725 |
| 4,907,483 | 3/1990 | Rose et al. | 84/726 |
| 4,913,024 | 4/1990 | Carriveau | 84/726 |

*Primary Examiner*—William M. Shoop, Jr.
*Assistant Examiner*—Jeffrey W. Donels
*Attorney, Agent, or Firm*—Laney, Dougherty, Hessin & Beavers

[57] ABSTRACT

Stringed instrument pickup and active switching circuitry that provide improvements in pickup sound combination, hum rejection and overall electronic function. The circuit employs plural pickups, a selected combination of which may be selected by a rotary switch. A latching device controlled by the switch outputs then produces a combination of control outputs to energize selected different FET switching devices to enable pickup signal outputs. Combined pickup signal outputs are then mixed and buffer amplified in a final output stage.

11 Claims, 2 Drawing Sheets

GUITAR PICKUP AND SWITCHING APPARATUS

BACKGROUND OF THE INVENTION

1. Field of the Invention

The invention relates generally to magnetic sound pickups for use with electric guitars and, more particularly, but not by way of limitation, it relates to improved pickup circuitry wherein a plurality of pickups are controlled by FET switching to render one of a selected plurality of sounds.

2 Description of the Prior Art

The use of plural, single or humbucking magnetic pickups on electric guitars has been well-known for a considerable time, and it is also a known practice to combine the pluralities of pickups in various ways to achieve certain sound differences and tonal variations. Gagon et al. U.S. Pat. No. 4,545,278 discloses a prior teaching wherein guitar pickup signals are selectively varied in accordance with a manual switch to change the output sound by emphasizing the characteristic sounds of the particular pickups. U.S. Pat. No. 2,784,631 in the name of Fender provides a quite early teaching directed to pickup combination switching to control output guitar sound. There are a number of other teachings which attempt various forms of tone control or variation of the sound character through a manually controllable switch whereby the guitar player has the capability of changing the type and presentation of guitar sounds through several variations. The present invention is an improved type of sound switching circuitry that gives more clear and concise reproduction of selected sound styles with greater ease of selection and clarity of sound.

SUMMARY OF THE INVENTION

The present invention uses a rotary switch having plural switch positions to select a specific combination of pickups yielding a definite sound variation. The guitar uses a single coil pickup on the neck, a humbucker pickup adjacent the bridge, and a hum cancel coil mounted in isolation. A selector switch with latching output and mute control then operates through a diode matrix to switch selected ones of FET devices thereby to select pickup combinations and mixing control to provide one of a plurality of "characteristic sound" buffered outputs to subsequent amplifier stages.

Therefore, it is an object of the present invention to provide pickup output having extremely low noise and wide bandwidth.

It is also an object of the present invention to provide individually buffered magnetic pickups that employ active pickup mixing and active hum rejection.

It is still further an object of the present invention to provide guitar pickup circuitry with solid state switching control and having DC servo controlled, low impedance output.

Finally, it is an object of the present invention to provide a guitar pickup circuit with plural magnetic pickups that are controllable to provide a selected one of several distinct, characteristic and clear guitar sounds at a buffered output Other objects and advantages of the invention will be evident from the following detailed description when read in conjunction with the accompanying drawings which illustrate the invention.

DETAILED DESCRIPTION OF THE INVENTION

Figure 1:
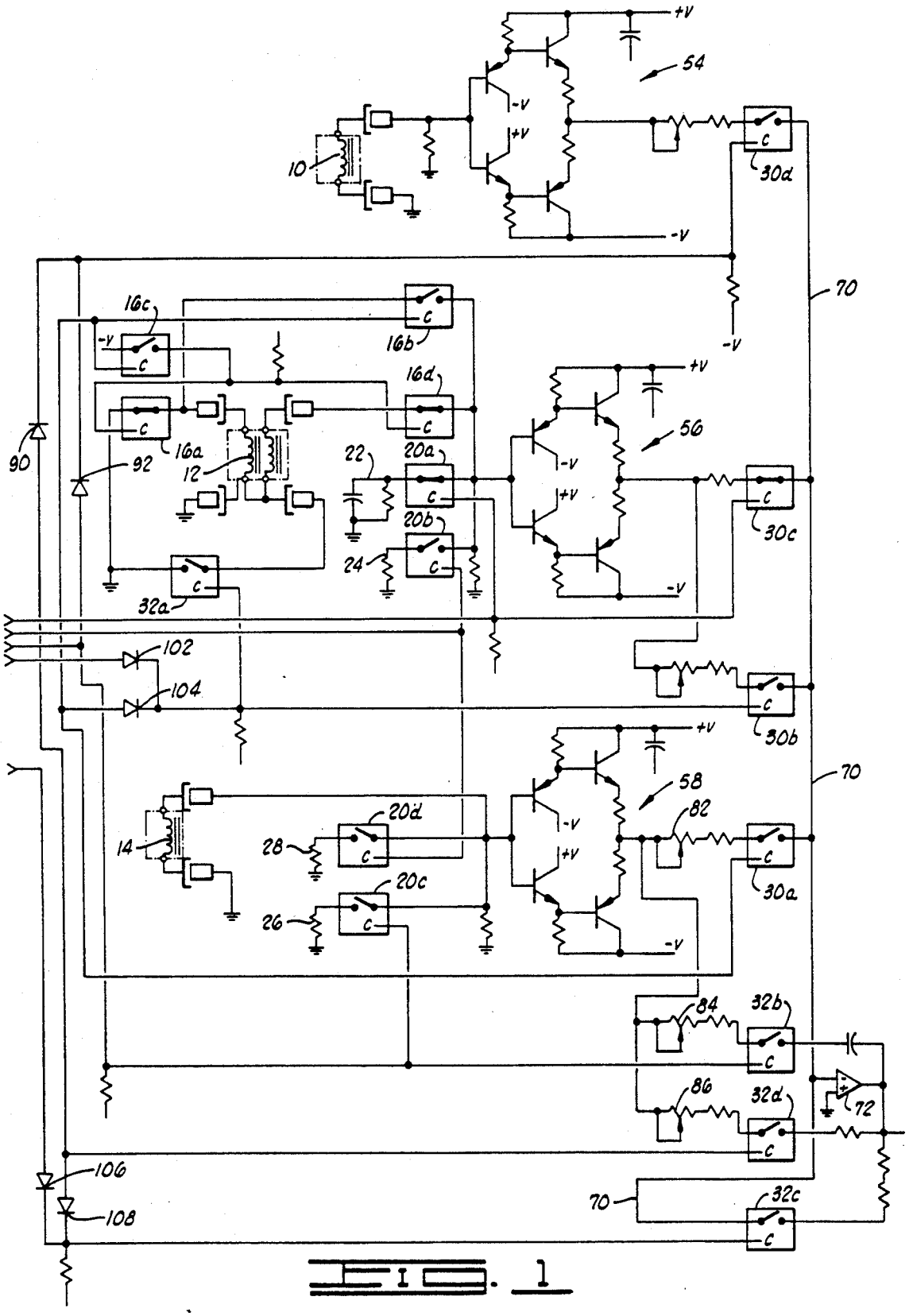
FIG. 1 is a schematic drawing of the pickup coil and FET switching and buffer circuitry of the invention.

Referring to FIG. 1, three guitar pickups are employed, a neck pickup 10 secured adjacent the neck, a dual-coil humbucker pickup 12 secured adjacent the guitar bridge, and a dummy or hum cancel coil 14 suitably retained in some vibration-free disposition. Each of the single pickup 10 and the humbucker pickup 12 may be well-known popular types that are readily available in the industry. FET switching is used for pickup coil selection as well as for gain settings, pickup loading changes and for power ON/OFF. The FET switch package employed for most of this type of switching is the type CD4066 CMOS Quad FET switch package. FET switches 16*a*, 16*b*, 16*c* and 16*d* are connected in control of the humbucker coil 12. Switch 16*a* functions to ground the backcoil of humbucker pickup 12 while switch 16*b* serves to select backcoil connection from humbucker 12. The FET switch 16*c* is the control inverter for switch logic, and switch 16*d* selects the front coil from humbucker pickup 12. It should be noted that switch positions in the drawings are shown for the No. 1 position of the rotary pickup selector 18 (see FIG. 3).

An FET switch 20*a* controls capacitive/resistive load 22 which serves to provide a LES PAUL TM sound, and switch 20*b* controls a resistor 24 that provides loading for the TELECASTER TM type of sound (as will be further described). The FET switch 20*c* controls a resistive load 26 for connection to the dummy pickup coil 14 in order to match the neck pickup, and switch 20*d* provides resistive load 28 for connection to the dummy coil 14 to match the "Tele" sound.

Still another FET switch section 30*a* controls variable gain from dummy coil 14, switch 30*b* controls variable gain from the humbucker pickup 12 output, switch 30*c* connects humbucker unity gain output and switch 30*d* connects output from the neck pickup 10. Finally, FET switch 32*a* is actuated to split the humbucker pickup 12 while switch 32*b* connects variable gain output from dummy coil 14, switch 32*c* provides variable gain for the mixing stage (to be described), and switch 32*d* provides variable gain output from the hum cancel or dummy coil 14.

Figure 2:
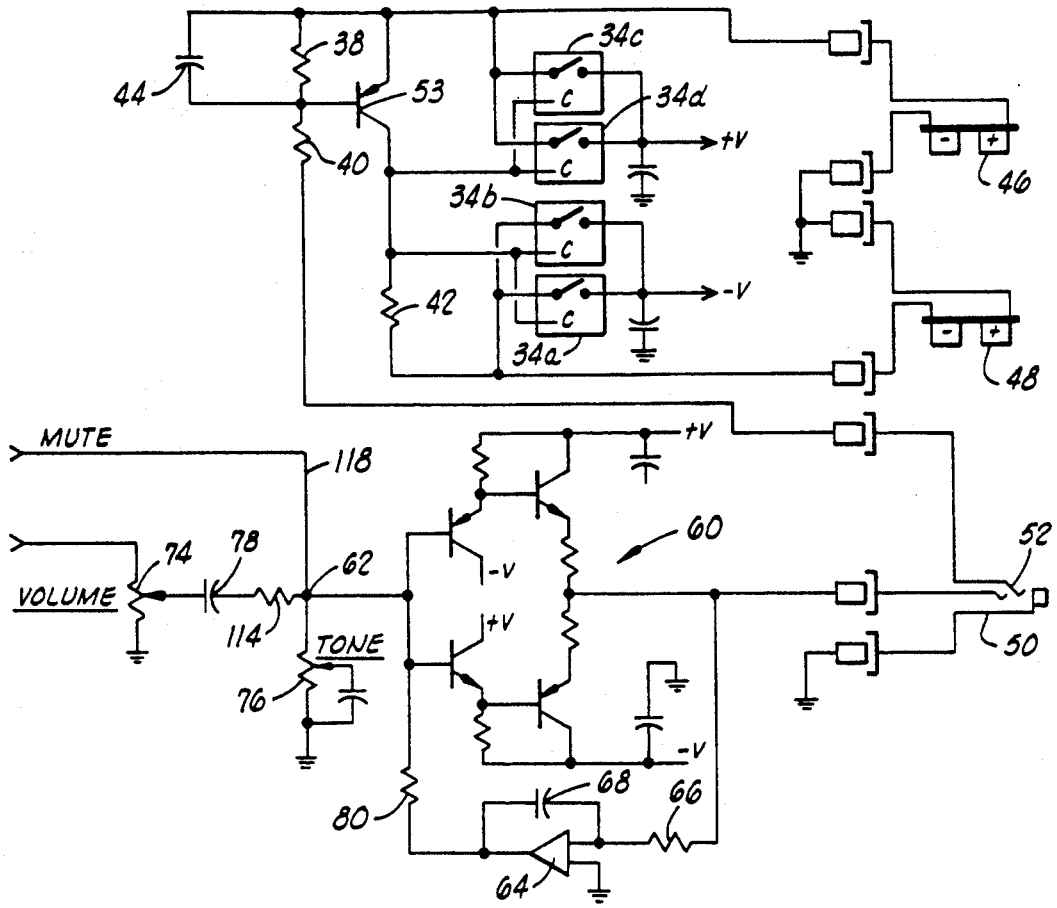
FIG. 2 is a schematic drawing of the power supply and output buffer circuitry of the invention.

Yet another FET switch 34 (sections a–d) functions as shown in conjunction with a transistor 53, resistors 38, 40 and 42, and capacitor 44 to provide a bipole power ON/OFF switch. See FIG. 2. A pair of 9-volt batteries 46 and 48 provide $+V_{dc}$ and $-V_{dc}$ power. This configuration allows the grounding of the connection 50 on stereo ¼ phone jack 52 to turn ON the bipolar power supply. When the base of transistor 53 is pulled to ground via resistor 40, transistor 53 turns ON pulling the four control inputs of FET switch 34 *a–d* high and this, in turn, switches on the positive and negative power supplies.

Referring again to FIG. 1, the circuit employs four unity gain low noise buffers, a buffer 54 receiving the output from neck pickup 10, a buffer 56 receiving output from the humbucker pickup 12, a buffer 58 receiving output from dummy coil 14, and (see FIG. 2) a buffer 60 receiving total output from a junction 62. Each of the unity gain buffers 54, 56 and 58 consists of a complementary emitter-follower configuration utilizing type 2N3906 and 2N3904 pairs of transistors. The similar basic configuration is used in buffer 60 (FIG. 2); however, this buffer also works in conjunction with a parallel amplifier stage 64 that acts as an integrator with a time constant as set by resistor 66 and capacitor 68. By buffering the outputs from the respective pickups, the resistive and capacitive pickup loading can be changed with no effect on the operation of the FET switching and mixing stages that follow.

Audio output from FET switches 30*d*, 30*c*, 30*b* and 30*a* as well as switches 32*b* and 32*d* are present on mixing bus 70 for input to the mixing amplifier 72. Output from mixer 72 is then passed through volume control potentiometer 74 to junction 62 (FIG. 2) as tone control potentiometer 76 connects to ground.

The junction 62 provides input to buffer circuit 60, the output buffer, which differs from the three pickup buffers 54, 56 and 58 due to the fact that it is DC servo corrected by amplifier 64. The integrator function carried out by amplifier 64 acts to adjust continuously the DC OFFSET at the input of the buffer so that the DC OFFSET at the output is 0 V. Therefore, there is no output coupling capacitor to affect the frequency response when driving low impedance loads (i.e., 600 ohm studio console inputs). The DC OFFSET at the output will be stable over a wide range of temperatures and over a long period of time due to its dynamic adjustment.

The output of mixing amplifier 72 (FIG. 1) is connected through potentiometer 74 that is configured as the volume control. Capacitor 78 (FIG. 2) decouples any DC error from the output of the mixing stage 72 thereby to filter out any undesirable subsonic components of sound. Capacitor 78 is also required to avoid forming a DC attenuator between the volume potentiometer 74 and a resistor 80. If such attenuation existed, then the DC servocorrection voltage would be reduced beyond the point of functionality.

In FIG. 1, hum and electromagnetic interference are cancelled by means of a dummy over hum cancel coil 14 that is used as an antenna. The dummy coil 14 is situated outside the area of guitar strings so that it does not pick up any of the audio signal, but it does pick up the same interference signal as the guitar pickups. The dummy coil is wired so that its signal is out of phase with the guitar pickups 10 and 12. When the signal from the dummy coil 14 is mixed in equal proportion with signals from guitar pickups 10 and/or 12, any interference signal will be cancelled. Trim pots 82, 84 and 86 are selected by FET switches 30*a*, 32*b* and 32*d*, respectively, to provide the matching level of hum cancelling signal that is required to match the various pickup combinations and levels.

Figure 3:
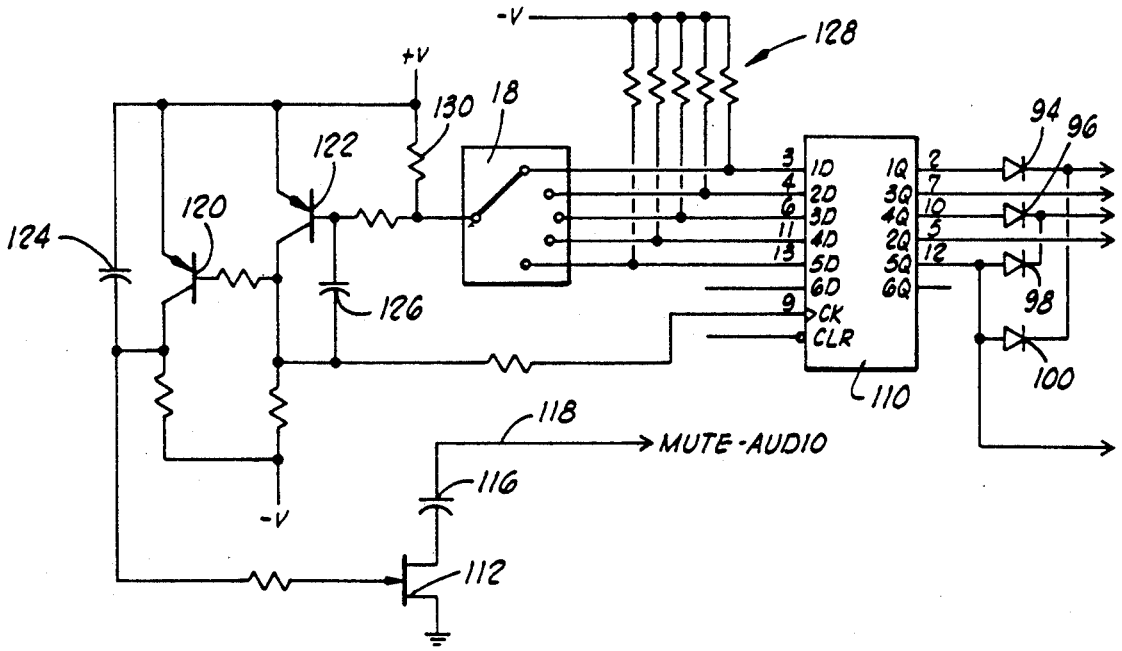
FIG. 3 is a schematic drawing of the select and latching circuitry of the present invention.

The various FET switching functions are accessed by a diode matrix comprised of ten diodes, viz. diodes 90 through 108 (see also FIG. 3). Selections made with the five-way rotary switch 18 are routed for input to a latching device 110, a type 40174 SMT integrated circuit. Outputs from latching device 110 are then routed to the various ones of diodes 90–108 to cause the switching function that produces the desired sounds. In a particular case, the switching device controls sound output as set forth in the following table.

TABLE I

List of the parameters that make up each sound.
Each of these parameters is selected by FET Switching.

| Selector | Sound | Pickup Coil | Pkup Gain | Mix Gain | Pkup Load | Hum Rej | HR Gain | HR Load |
|---|---|---|---|---|---|---|---|---|
| 1 | Les Paul | Full Humbucker | × 1 | × 1 | 82K + 1500pF | No | — | — |
| 2 | Strat | Neck | × 1.3 | × .5 | 36K | Yes | × 2.4 | 110K |
| | | Front Humbucker | × 1.5 | | 1M | Yes | | 110K |
| 3 | Tele | Back Humbucker | × 2 | × 1 | 47K | Yes | × 1.9 | 43K |
| 4 | Strat Rhythm | Neck | × 1.75 | × 1 | 36K | Yes | × 1.5 | 40K |
| 5 | Jazz Lead | Neck + | × 2 | × .5 | 36K | Yes | × 1.3 | 12K |
| | | Full Humbucker | × 1 | | 82K + 1500pF | | | |

The FET switching creates voltage spikes that would be audible when the selector switch 18 is operated if a de-glitching circuit was not in place. De-glitching is implemented by muting the signal at the input to the output buffer 60 while FET switching is taking place. Thus, a muting transistor 112 (FIG. 3), an FET type 2N4391, is used as a voltage controlled resistor. In conjunction with resistor 114 (FIG. 2) in the input to output buffer 60, the FET transistor 112 forms a voltage controlled attenuator. The capacitor 116 in lead 118 is required to block the FET controlled voltage from input to the buffer 60.

In order to first perform the mute and then do the FET switching prior to an un-mute, a timing sequence is required. The combination of selector switch 18, transistor 120 and transistor 122 function under control of capacitors 124 and 126 and various resistance elements which generate the de-glitch timing. The entire action of the de-glitch circuit provides as follows: when the operator starts to rotate switch 18, it breaks its current contact and the wiper which has been held low by one of resistors 128 is pulled HIGH by resistor 130. This causes the collector of transistor 122 to switch LOW and latching device 110 is unaffected as it only latches on the positive edge of the clock input. As transistor 122 collector swings negative, it causes the transistor 120 to turn ON, and this action discharges capacitor 124 to pull the collector of transistor 120 HIGH thereby to turn on the mute.

As the operator continues to turn the switch, a few milliseconds later the wiper will make a new contact. This will cause the wiper to once again be pulled LOW which action turns on transistor 122 by pulling its collector to +VDC to latch the new selection on rotary switch 18 to the outputs of transistor 120 and via a selected control diode to the FET switching. At this point any switching glitches are muted as the mute is still in effect. When transistor 122 turns ON, it turns OFF transistor 120, and with transistor 120 OFF, the capacitor 124 charges until the collector of transistor 120 reaches a negative voltage and the mute is turned off.

The present circuitry is a combination of active electronics and selected pickups that uses various techniques for modification of the sound produced by the pickups. The resulting system enables the guitar to make "new" sounds as well as to emulate the characteristic sound of known guitar-types. The system uses a humbucker coil 12 in the bridge position and a single pickup coil 10 in the neck position. It is further characterized by a "buffered" volume control as volume control potentiometer 74 is connected directly to the input of output buffer 60. A 5-way rotary selector switch (FIG. 3) allows manual selection of the particular guitar sounds as above-described. In one sense, then, the "pickup selector" has become a sound selector. In order to achieve each sound, pickup selection and a number of additional functions are controlled by solid state switching and the rotary pickup selector switch 18 serves as a manual interface to the solid state FET switching circuitry.

The present amplifier circuitry gains advantage from three basic principles:

(1) pickup placement, (2) pickup loading, i.e., the resistance and capacitance that the pickup effectively sees looking into the respective buffer, and (3) pickup coil selection.

The effects of pickup placement are critical. The space between pickups 10 and 12 must be just right in order to achieve the "strat" sound, and the back humbucker coil, rearmost of humbucker coil 12, has to be the correct distance from the bridge in order to get the "tele" sound.

The full effects of pickup loading are very critical. If the initial load is relatively light and then slowly increased, and a measure is taken of the resonance and the frequency response to the pickup, it will be observed that they both change, and at certain critical points, they change quite dramatically. The pickup outputs sound brighter or snappier when used with lighter loads, and they sound darker or thicker when used with heavier loads. It could be said that within limits the present system functions to tune the pickup's characteristics.

Examples of pickup coil selection would be the coil combinations wherein the "strat" sound uses the neck pickup 10 and the humbucker coil 12 that is furthest from the bridge. On the other hand, the TELECASTER TM would use the humbucker coil 12 that is closest to the bridge in combination with neck pickup 10.

Use of the buffered volume control 74 assures that there is no loss of treble or change in tone when the volume is partially turned down. This method of buffering also serves the problems associated with the driving cable, i.e., the output signal is very consistent and cannot be degraded by a partially damaged, kinked or corroded cable. The tone control potentiometer 76 differs from a regular or state of the art tone control by virtue of the fact that when it is "dialed out", it is totally out of the circuit. This is in contrast to regular passive tone controls which tend to drain a little of the treble out of the sound even when potentiometer resistance is eliminated.

The present circuitry uses two 9-Volt batteries 46, 48 as arrayed in a bipolar ±9-volt supply. Good bipolar audio designs have proven to be superior to single supply designs in all areas, i.e., distortion, speed, noise, etc. In addition, it has the capability of handling instantaneous peak voltage spikes with much less loss.

The foregoing discloses an audio switching and amplifier system that utilizes discrete, bipolar audio electronics to achieve reproduction with extremely low noise and wide bandwidth. The circuitry employs individually buffered pickups with active pickup mixing and hum rejection thereby to achieve maximum transition and fidelity. A DC servo-controlled, low impedance output stage coupled with solid state switching control serves to eliminate switching click and other forms of interference while also allowing pickup sound selection with maximum clarity.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. Apparatus for electrically sensing and preparing instrument string sounds for audible reproduction, comprising:

a neck pickup, a bridge humbucker pickup, and a dummy coil located in isolation to the string vibrations;

a first buffer amplifier and FET switch for providing a first output signal from said neck pickup;

FET switch means for selecting one of varied coil outputs from the humbucker pickup;

a second buffer amplifier and FET switch for providing a second output signal from said humbucker pickup;

a third buffer amplifier and FET switch for providing a third output signal from said dummy coil;

output mixer and buffer means receiving any of said first, second and third output signals to provide a mixed output signal, said output mixer and buffer means including a buffer circuit and integrator means, connected between and output of said buffer circuit and an input of said buffer circuit, for adjusting a dc offset at the input of said buffer circuit so that a dc offset at the output of said buffer circuit is substantially zero thereby for obviating said output having an output coupling capacitor; and multi-position selector means generating at each position a characteristic combination of at least one control signals for controlling selected ones of FET switches and the FET switch means thereby to select the combination of output signals contributing to the mixed output signal.

2. Apparatus as set forth in claim 1 wherein:

said outputmixer and buffer means further includes a mixing amplifier and an input coupling capacitor connected between an output of said mixing amplifier and the input of said buffer circuit.

3. Apparatus for electrically sensing and preparing guitar string sounds for audible reproduction, comprising:

a first pickup connected to the guitar adjacent a neck of the guitar;

a second pickup connected to the guitar adjacent a bridge of the guitar;

a third pickup connected to the guitar at a string-vibration-free disposition thereof;

a first electrical load for connecting to said second pickup for emulating a first predetermined type-of-guitar sound;

a second electrical load for connecting to said second pickup for emulating a first predetermined type-of-guitar sound;

a first buffer having an input connected to said first pickup;

a second buffer having an input selectably connectible to said second pickup and said first and second electrical loads;

a third buffer having an input connected to said third pickup;

a mixing amplifier having an input and an output;

first switch means for selectably connecting an output of said first buffer to the input of said mixing amplifier;

second switch means for selectably connecting an output of said second buffer to the input of said mixing amplifier;

third switch means for selectably connecting an output of said third buffer to the input of said mixing amplifier;

a fourth buffer having an input connected to the output of said mixing amplifier; and plural position selector means for selectably actuating a predetermined combination of said first and second electrical loads and said first, second and third switch means for each selector position so that for each selector position electrical signals are provided at an output of said fourth buffer for audible reproduction as one of a plurality of predetermined type-of-guitar sounds responsive to playing the guitar strings.

4. Apparatus as set forth in claim 3 further comprising:

integrator means, connected between the output of said fourth buffer and the input of said fourth buffer, for adjusting a dc offset at the input of said fourth buffer so that a dc offset at the output of said fourth buffer is substantially zero without the output of said fourth buffer having an output coupling capacitor.

5. Apparatus as set forth in claim 4 further comprising:

an input coupling capacitor connected between the output of said mixing amplifier and the input of said fourth buffer.

6. Apparatus as set forth in claim 5, further comprising:

a de-glitching circuit connected to said selector means and said fourth buffer to mute a signal at the input of said fourth buffer during operation of said selector means.

7. Apparatus as set forth in claim 6, further comprising:

a bi-polar +/− 9-volt power supply.

8. Apparatus for electrically sensing and preparing guitar string sounds for audible reproduction, comprising:

a first pickup connected to the guitar adjacent a neck of the guitar;

a second pickup connected to the guitar adjacent a bridge of the guitar;

a third pickup connected to the guitar at a string-vibration-free disposition thereof;

variable loading means for selectably varying a load connected to said second pickup for emulating a predetermined guitar sound;

a first buffer having an input connected to said first pickup;

a second buffer having an input connected to said variable loading means;

a third buffer having an input connected to said third pickup;

a mixing amplifier having an input and an output;

first switch means for selectably connecting an output of said first buffer to the input of said mixing amplifier;

second switch means for selectably connecting an output of said second buffer to the input of said mixing amplifier;

third switch means for selectably connecting an output of said third buffer to the input of said mixing amplifier;

a fourth buffer having an input connected to the output of said mixing amplifier;

plural position selector means for selectably actuating a predetermined combination of said variable loading means and said first, second and third switch means for each selector position so that for each selector position electrical signals are provided at an output of said fourth buffer for audible reproduction as one of a plurality of predetermined types of sounds responsive to playing the guitar strings; and integrator means, connected between the output of said fourth buffer and the input of said fourth buffer, for adjusting a dc offset at the input of said fourth buffer so that a dc offset at the output of said fourth buffer is substantially zero without the output of said fourth buffer having an output coupling capacitor.

9. Apparatus as set forth in claim 8 further comprising:

an input coupling capacitor connected between the output of said mixing amplifier and the input of said fourth buffer.

10. Apparatus as set forth in claim 9, further comprising:

a de-glitching circuit connected to said selector means and said fourth buffer to mute a signal at the input of said fourth buffer during operation of said selector means.

11. Apparatus as set forth in claim 10, further comprising:

a bi-polar +/− 9-volt power supply.

* * * * *

UNITED STATES PATENT AND TRADEMARK OFFICE

CERTIFICATE OF CORRECTION

PATENT NO. : 5,136,919

DATED : August 11, 1992

INVENTOR(S) : Robert J. Wolstein

It is certified that error appears in the above-identified patent and that said Letters Patent is hereby corrected as shown below:

Column 6, line 53 (Claim 2), delete "outputmixer" and insert --output mixer-- therefor.

Column 7, line 2 (Claim 3), delete "first" and insert --second-- therefor.

Signed and Sealed this

Seventh Day of September, 1993

Bruce Lehman

*Attest:*

BRUCE LEHMAN

*Attesting Officer*

*Commissioner of Patents and Trademarks*